US007930793B2

(12) United States Patent
Stydahar

(10) Patent No.: US 7,930,793 B2
(45) **Date of Patent: *Apr. 26, 2011**

(54) HAIRBRUSH

(76) Inventor: George Stydahar, Croton on Hudson, NY (US)

( * ) Notice: Subject to any disclaimer, the term of this patent is extended or adjusted under 35 U.S.C. 154(b) by 271 days.

This patent is subject to a terminal disclaimer.

(21) Appl. No.: 12/114,508

(22) Filed: May 2, 2008

(65) Prior Publication Data

US 2009/0272393 A1 Nov. 5, 2009

(51) Int. Cl.
*A45D 24/00* (2006.01)
*A45D 24/16* (2006.01)

(52) U.S. Cl. ..... 15/201; 15/27; 15/207.2; 132/200; 132/120; 132/238

(58) Field of Classification Search ..... 15/201
See application file for complete search history.

(56) References Cited

U.S. PATENT DOCUMENTS

| | | | | |
|---|---|---|---|---|
| 793,234 | A * | 6/1905 | Scanlan | 15/22.3 |
| 866,019 | A | 9/1907 | Handel | |
| 2,202,285 | A | 4/1937 | Dunnam | |
| 2,460,548 | A | 3/1946 | Stewart | |
| 2,496,010 | A | 7/1948 | Lotters | |
| 4,197,608 | A | 4/1980 | Holley et al. | |
| 4,664,132 | A | 5/1987 | Schillig | |
| 4,685,165 | A | 8/1987 | Fronius | |
| 5,133,712 | A | 7/1992 | McPherson | |
| 5,427,120 | A | 6/1995 | Wong | |
| 5,502,860 | A | 4/1996 | Franke | |
| 5,584,088 | A | 12/1996 | Pauldine | |
| 6,098,635 | A | 8/2000 | Marino | |
| 2003/0131865 | A1 | 7/2003 | Richmond et al. | |
| 2008/0098541 | A1 | 5/2008 | Stydahar | |

FOREIGN PATENT DOCUMENTS

| | | | |
|---|---|---|---|
| GB | 2375038 A | * | 6/2002 |
| GB | 2375038 A | | 11/2002 |

* cited by examiner

*Primary Examiner* — Monica S Carter
*Assistant Examiner* — Stephanie Newton
(74) *Attorney, Agent, or Firm* — Baker & Hostetler LLP

(57) ABSTRACT

An apparatus for removing a hair tangle is provided that moves the hair brush having a first bristle on a rotatable brush element through the hair above the tangle in a first direction, pivots the first bristle on the rotatable brush element about a pivotal axis of the brush in a second direction if the hair tangle is encountered by the bristle, moves a second bristle on the rotatable brush element through the hair below the tangle, and moves additional bristles to a side of the tangle in order to release the hair tangle.

21 Claims, 5 Drawing Sheets

HAIRBRUSH

FIELD OF THE INVENTION

The present invention relates generally to hairbrushes. More particularly, the present invention relates to hairbrushes having rotatable bristles.

BACKGROUND OF THE INVENTION

Hairbrushes are used for grooming and untangling hair. A conventional hairbrush includes a handle portion and a bristled portion having bristles thereon. The bristles may be generally on one side of the hairbrush or may be disposed about the periphery of the brush. Tangled hair is a common problem. The bristles are fixed on the brush and are used to untangle the hair as they move through the hair strands. Typically, a user moves the bristles through the hair strands until the bristles encounter a tangle. When a tangle is reached, the user may pull harder on the hair in hopes of untangling the hair. Alternatively, the user may withdraw the bristles from the hair and reposition the hairbrush in the hair in an attempt to brush around the tangle to loosen the hair. Brushing tangled hair can be painful and may cause hair loss because the bristles do not have any give when encountering a tangle.

SUMMARY OF THE INVENTION

The foregoing needs are met, to a great extent, by the present invention, wherein in one aspect an apparatus is provided that in some embodiments allows a set of bristles to rotate in a direction opposite a direction of brushing.

An embodiment of the present invention provides a brush for grooming hair which has a brush body having a handle portion and a bristle carrier portion. The bristle carrier portion has an outer periphery and defines a longitudinal axis. A plurality of brush elements have a plurality of bristles mounted thereon and are moveably mounted on the bristle carrier portion. The plurality of bristles extend generally radially outward from the longitudinal axis and the plurality of brush elements are arrayed generally longitudinally along a length of the bristle carrier portion. Each of the plurality of brush elements are configured to rotate independently from one another, and the plurality of bristles are configured so that when one of the plurality of bristles encounters a resistance from a hair, the respective brush element having the one of the plurality of bristles encountering the resistance will move in an opposite direction of brushing thereby causing the one of the plurality of bristles encountering the resistance to move out of engagement with the hair and another one of the bristles on the respective brush element to move into engagement with the hair at a location spaced from the location of the hair with caused the resistance.

Another embodiment provides a method of removing a hair tangle with a hair brush containing bristles that includes moving the hair brush having a first bristle on a rotatable brush element through the hair above the tangle in a first direction, pivoting the first bristle on the rotatable brush element about a pivotal axis of the brush in a second direction if the hair tangle is encountered by the bristle, moving a second bristle on the rotatable brush element through the hair below the tangle, and moving additional bristles to a side of the tangle in order to release the hair tangle.

Yet another embodiment provides a brush body having a handle portion and a bristle carrier portion. The bristle carrier portion defines a longitudinal axis. A plurality of brush elements having a plurality of bristles mounted thereon are moveably mounted on the bristle carrier portion. The plurality of bristles extend generally radially outward from the longitudinal axis, and the plurality of brush elements are arrayed generally longitudinally along a length of the bristle carrier portion. Each of the plurality of brush elements are configured to rotate independently from one another, and wherein the plurality of bristles are configured so that when one of the plurality of bristles encounters a resistance from a hair, the respective brush element having the one of the plurality of bristles encountering the resistance will move in an opposite direction of brushing thereby causing the one of the plurality of bristles encountering the resistance to move out of engagement with the hair and another one of the bristles on the respective brush element to move into engagement with the hair at a location spaced from the location of the hair with caused the resistance. An adjusting mechanism is located within the handle portion and is operatively engaged with the plurality of brush elements to adjust a rotational resistance applied to the plurality of brush elements.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
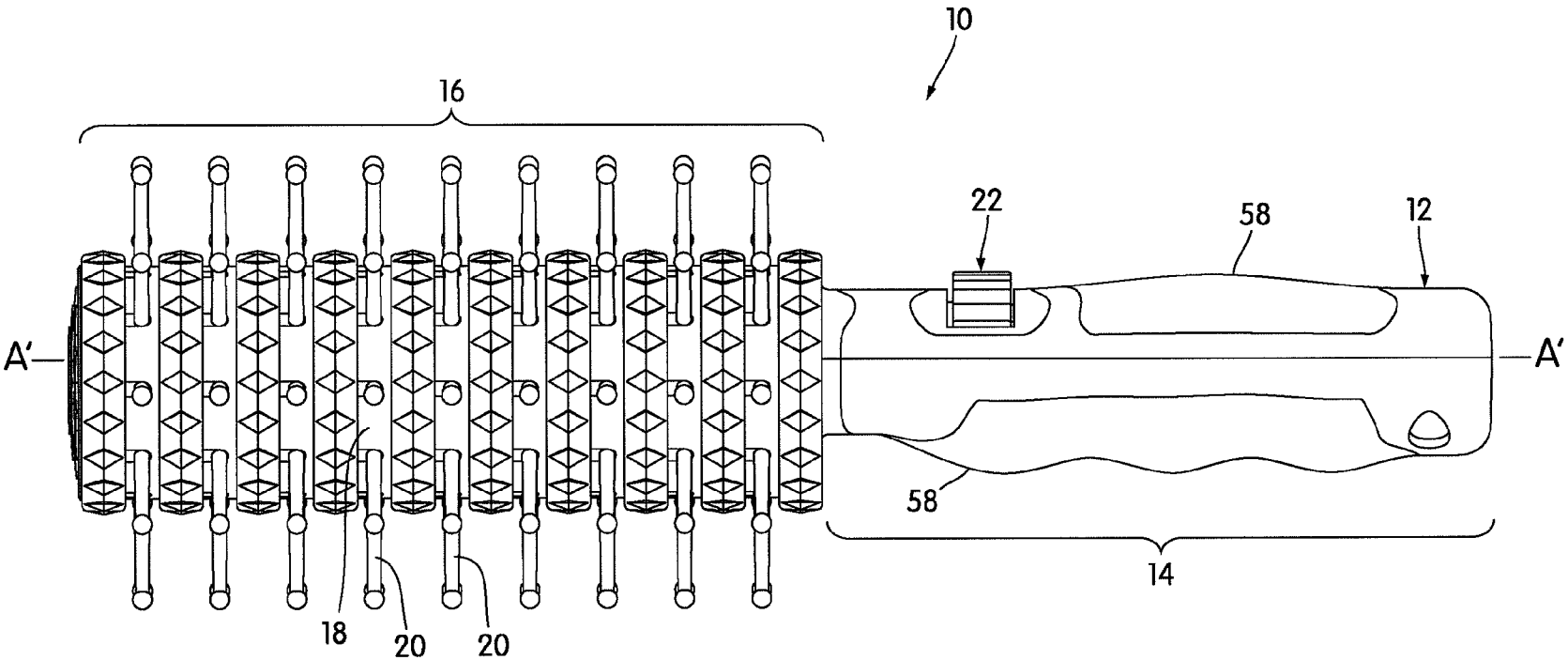
FIG. 1 is a side elevational view of a hairbrush according to an embodiment of the invention.
Figure 2:
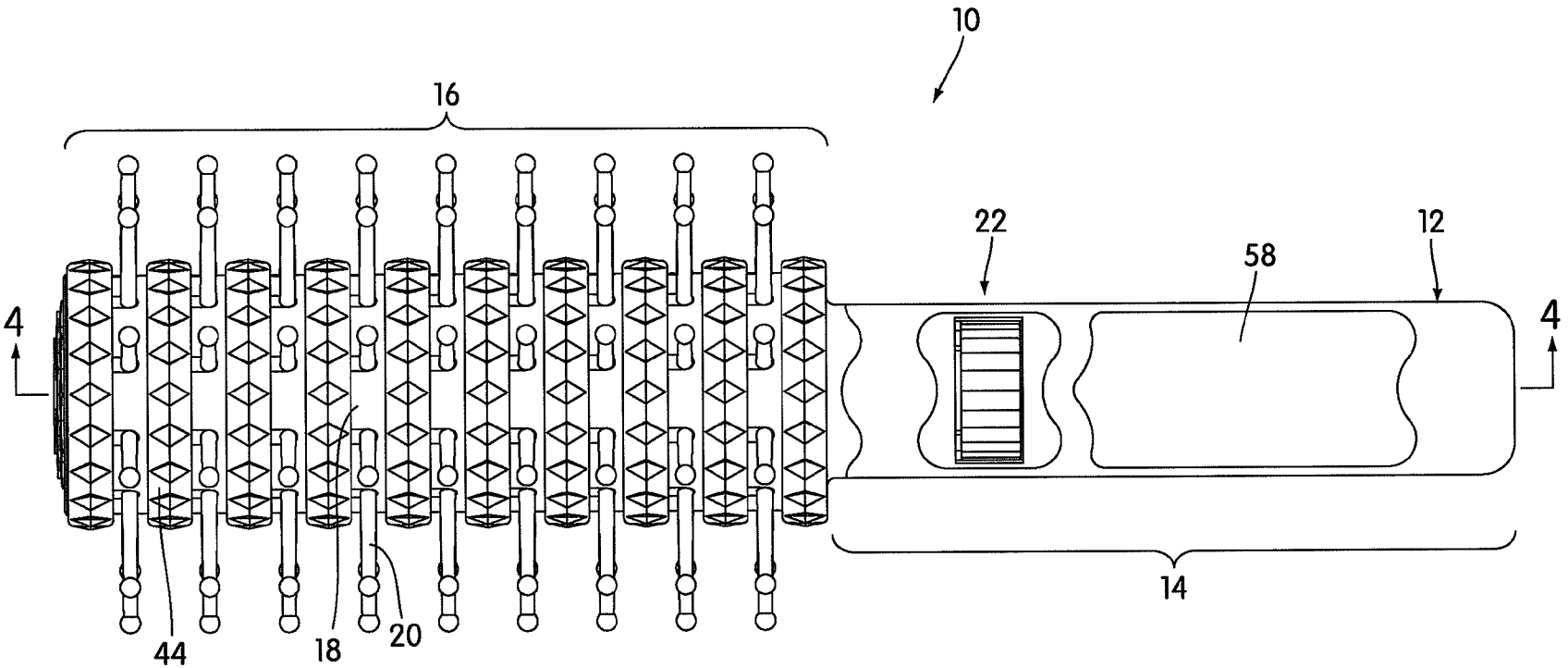
FIG. 2 is atop plan view of the hairbrush of FIG. 1.

The invention will now be described with reference to the drawing figures, in which like reference numerals refer to like parts throughout. An embodiment in accordance with the present invention provides an apparatus and method to brush hair more quickly, with less pull, pain or hair loss than a conventional hairbrush.

FIG. 1 shows a hairbrush 10 for grooming hair that includes a brush body 12 having a handle portion 14 configured to be gripped by a hand of a person brushing hair and a bristle carrier portion 16 on which a plurality of brush elements 18 are mounted. The bristle carrier portion 16 has an outer periphery and a generally longitudinally extending axis A'-A' (shown in FIG. 1). The brush elements 18 are moveably mounted on the bristle carrier portion 16 of the brush body 12 and provide a plurality of bristles 20. The bristles 20 extend generally radially outwardly from the longitudinal axis of the bristle carrier portion 16 and the bristles 20 are arrayed generally longitudinally along a length of the bristle carrier portion 16.

When the brush body 12 moves along a length of hair being brushed, the bristles 20 move through the hair being brushed. Movement of the bristles 20 combs the hair. When a moving bristle 20 encounters a tangle, the tangle applies a force to the bristle 20 which resists the movement of the bristle 20 through the hair. Each brush element 18 rotates independently about the periphery of the bristle carrier portion 16. When a force above a predetermined magnitude is applied to a bristle 20 by a tangle during a brushing motion, continued movement of the brush body causes the one bristle 20 encountering the resistance to move out of engagement with the tangled hair at the location of the resistance and causes another one of the bristles 20 on the particular brush element 18 to move into engagement with the hair at a location spaced from the location of the tangled hair with caused the resistance.

The hairbrush 10 includes an adjusting mechanism 22 operatively engaged with the plurality of brush elements 18 and constructed and arranged to adjust the resistance applied to the plurality of brush elements 18 to adjust the amount of force required to induce rotational movement of the plurality of brush elements 18 about the longitudinal axis of the bristle carrier portion 16. More specifically, the adjusting mechanism 22 can increase or decrease the amount of force required to be applied to each bristle 20 to rotate an individual bristle 20.

Figure 3:
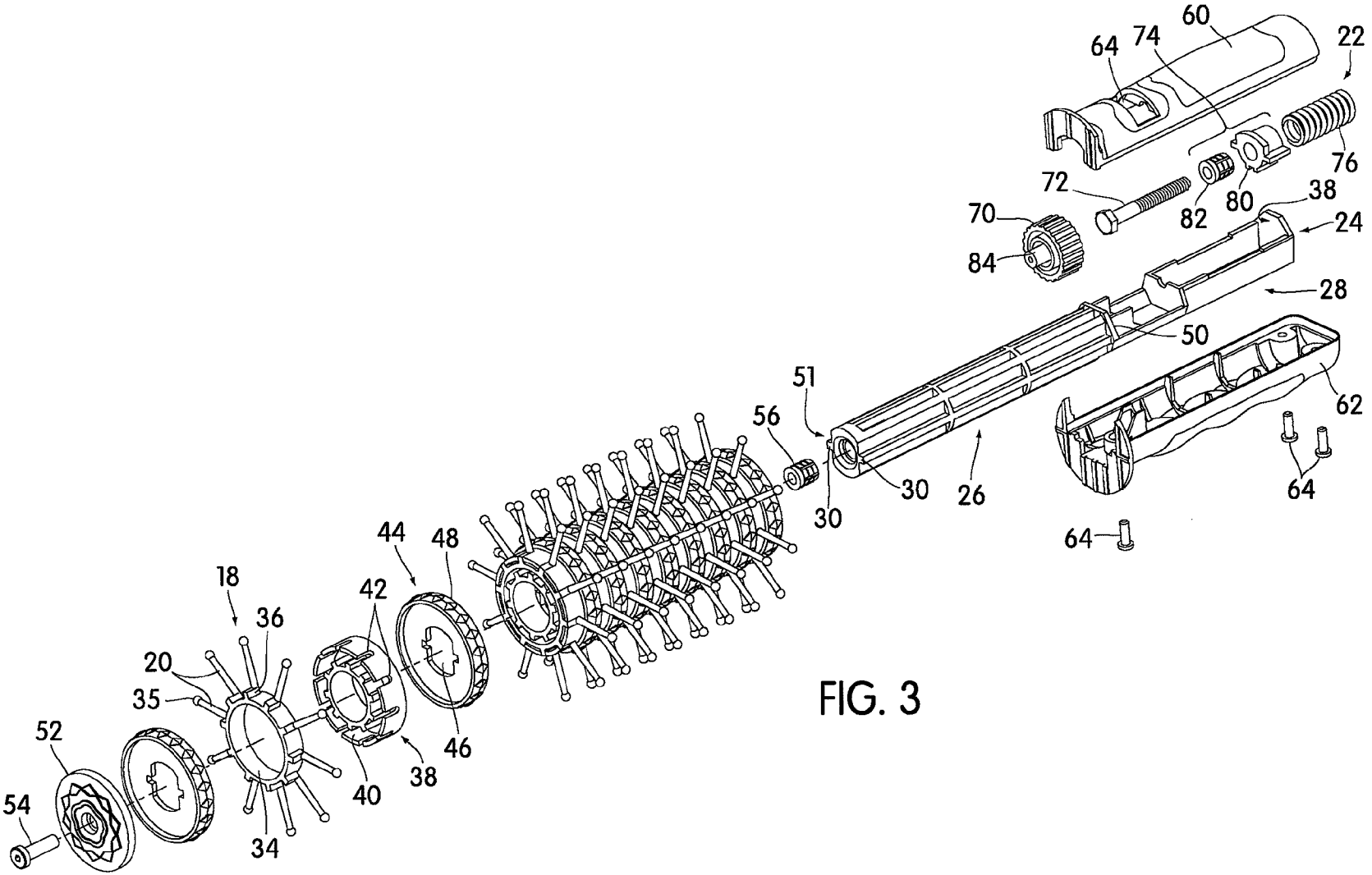
FIG. 3 is a partially exploded view of the hairbrush of FIG. 1.

The construction of the hairbrush 10 can be appreciated from FIG. 3. The hairbrush 10 includes a brush core 24 which may be an integral structure constructed of a metal, a molded plastic, or of any other suitable material. The core 24 includes a bristle mounting section 26 and a handle section 28. The bristle mounting section 26 includes a pair of integral ribs 30. The handle section 28 includes an end wall 32.

Each brush element 18 is an integral structure which may be constructed of any suitable material such as a metal or a molded plastic. The bristles 20 are evenly spaced about a ring-shaped core structure 34 of each brush element 18. There may, for example, be 6 or 8 evenly spaced bristles 20 around the brush element 18. In addition, each bristle 20 may be formed to include an enlarged end portion 35 at the tip to protect the scalp. A wall section 36 is formed at the base of each bristle 20 to strengthen the bristles 20. The wall section 36 is a raised portion arranged at the base of each of the bristles 20 and located about the ring-shaped core structure 34.

Figure 5:
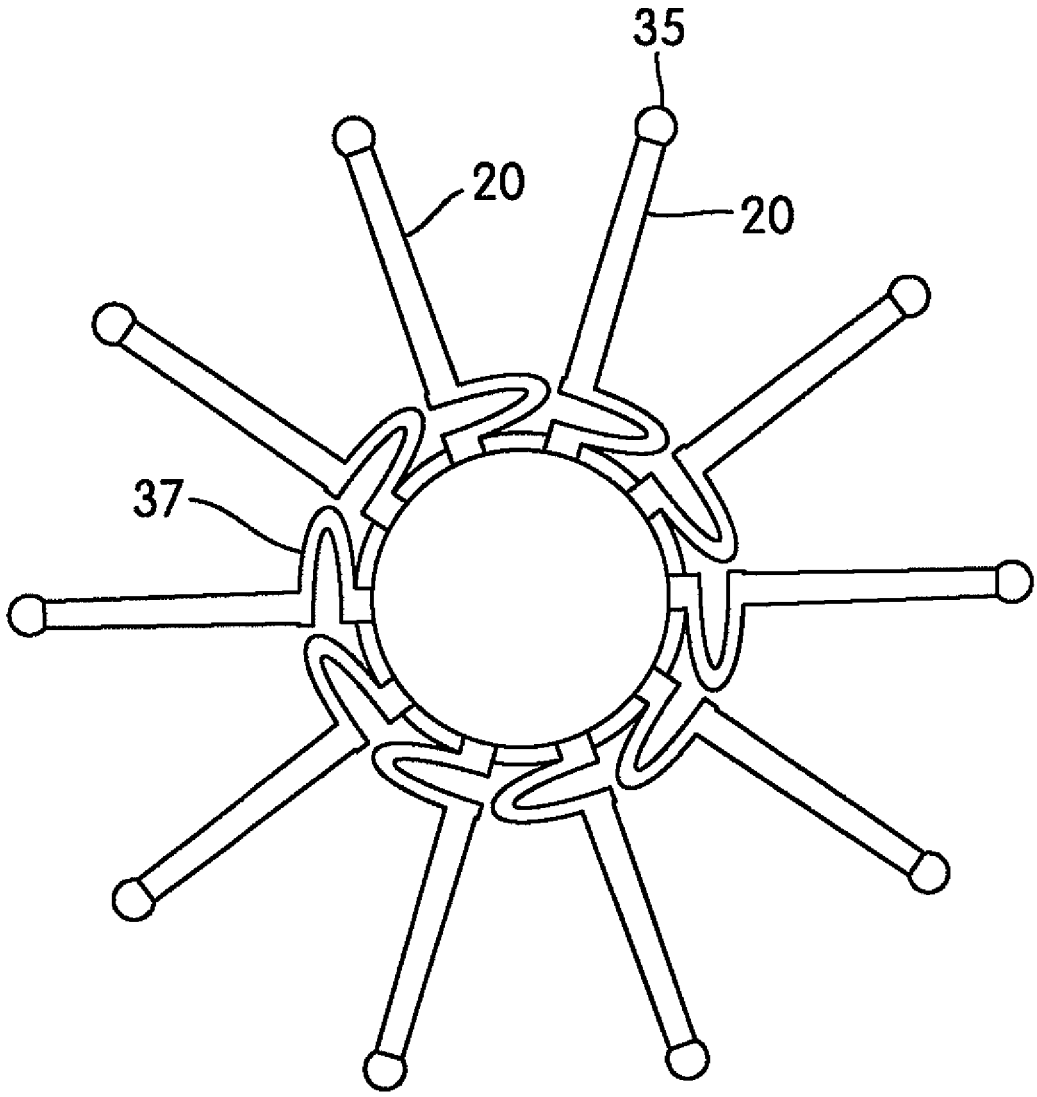
FIG. 5 is a front elevational view of an embodiment of hair bristles.

Alternatively, as shown in FIG. 5, the ring-shaped core structure 34 may be optionally configured to provided elasticity or flexibility to each of the bristles 20. As shown in FIG. 5, a base of each bristle 20 may be configured with a generally wedge-shaped portion 37 to provide some give to each of the bristles when they are pressed against the scalp. Thus, during a brushing motion, as the bristles 20 are placed against the scalp, the cushioning provided by the flexing bristles 20 reduces discomfort to the user.

The core structure 34 of each brush element 18 is mounted within a brush element housing 38. Each housing 38 may be an integral structure constructed of any suitable material such as a metal or a molded plastic. Each housing 38 of each brush element 18 includes an inner rotation surface 40 and a series of slots 42. Each brush element 18 is mounted in a brush element housing 38. Each bristle 20 and the associated wall section 36 extend through a slot 42. The wall sections 36 are essentially flush with the exterior surface of the housing 38. Each brush element 18 and the associated brush element housing 38 is mounted on the bristle section 26 of the core 24. Each brush element 18 is free to rotate about the core 24 in either rotational direction.

A series of spacer elements 44 are mounted to the body portion 12 of the hairbrush 10 and arranged along the body portion 12 adjacent to the bristle carrier portion 16 of the hairbrush 10. The spacer elements 44 are disposed between the brush elements 18, and mounted to each side of a brush element 18 on the section 26 of core 24. The spacer elements 44 provide a flat and even surface against which the spacer elements 44 can engage a respective flat surface of the brush elements 18 and the housing 38. The engagement of the flat surface of the spacer elements 44 with the brush elements 18 allows for even and consistent pressure to be applied to all of the brush elements 18, and for predictable and reliable frictional resistance to be applied to the brush elements 18. The spacer elements 44 may be an integral structure constructed of any suitable material such as a metal or a molded plastic.

The spacer elements 44 are non-rotatable elements. The rotation of the spacer elements 44 is prevented by engagement between each spacer slot 46 and a respective rib 30 on the core 24, for example. The spacer elements 44 completely isolate the rotational effect of the brush elements 18 so that the movement of one of the brush elements 18 has no effect on any other of the brush elements 18. Thus, for a respective spacer element 44 with a brush element 18 mounted to each side, the rotation of the brush element 18 on one side does not cause the brush element 18 on the other side to rotate.

Each spacer element 44 includes a central opening having a pair of slots 46 and an outer perimeter wall section 48. The outer perimeter wall section 48 of the spacer elements 44 define a recessed portion to either side of the spacer element 44 to receive and house the brush element housing 38. This arrangement between the spacer element 44 and the brush element housing 38 serves at least in part to keep the components in alignment and to provide a seal between the brush elements 18 so that hair is not caught between the rotational brush elements 18.

A series of brush elements 18 and spacer elements 44 are mounted between an integral intermediate wall portion 50 formed on the core 24 and a free end 51 of the core 24. The length of the hairbrush 10 between the intermediate wall portion 50 formed on the core 24 and the free end 51 may be about four inches in length, but may also be configured to be shorter or longer. One or more spacer elements are arranged along the bristle carrier portion adjacent to one or more of the brush elements 18. The brush elements 18 and the spacer elements 44 are held on the core 24 by an end cap 52 in the assembled hairbrush 10. The cap 52 held in place by a threaded fastener 54. The fastener 54 threadedly engages an internally threaded member 56 which is fixedly mounted in an end of the core 24. The cap 52 may be constructed of any suitable material such as a metal or a plastic. The threaded member 56 may be a metal structure constructed of any suitable material such as a brass.

The handle portion 14 is an elongated handle portion configured with a gripping surface 58. The gripping surface 58 may be an ergonomic gripping surface. The handle portion 14 is comprised of a pair of handle housing members 60, 62. The housing 60 has an opening 64. Each of the handle housing members 60, 62 may be an integral structure constructed of any suitable material such as a metal or a molded plastic. A material that provides cushioning to a gripping hand may be provided on portions of the handle housing members 60, 62. The handle housing members 60, 62 are held together by threaded fasteners 64, but any other suitable method or construction may be used to hold the members 60, 62 together. The assembled handle housing members 60, 62 are mounted about section 28 of the core 24. The core 24 is moveable in a longitudinal direction with respect to the handle housing members 60, 62.

The adjusting mechanism 22 is disposed within the handle housing 60, 62. The adjusting mechanism 22 includes a thumb wheel 70, an externally threaded shaft 72, an internally threaded spring engaging structure 74 and a coil spring 76. The thumb wheel 70 is an integral structure which may be constructed of any suitable material such as a molded plastic or a metal. The threaded shaft 72 may be provided by a bolt having a hexagonal head 78 as in the illustrative embodiment. The spring engaging structure 74 in the illustrative embodiment is comprised of an integral spring engaging member 80 and an internally threaded member 82. The member 80 may be constructed of a molded plastic or any other suitable material. The threaded member 82 is fixedly secured within the spring engaging member 80 and may be constructed of a suitable metal such as a brass.

Figure 4:
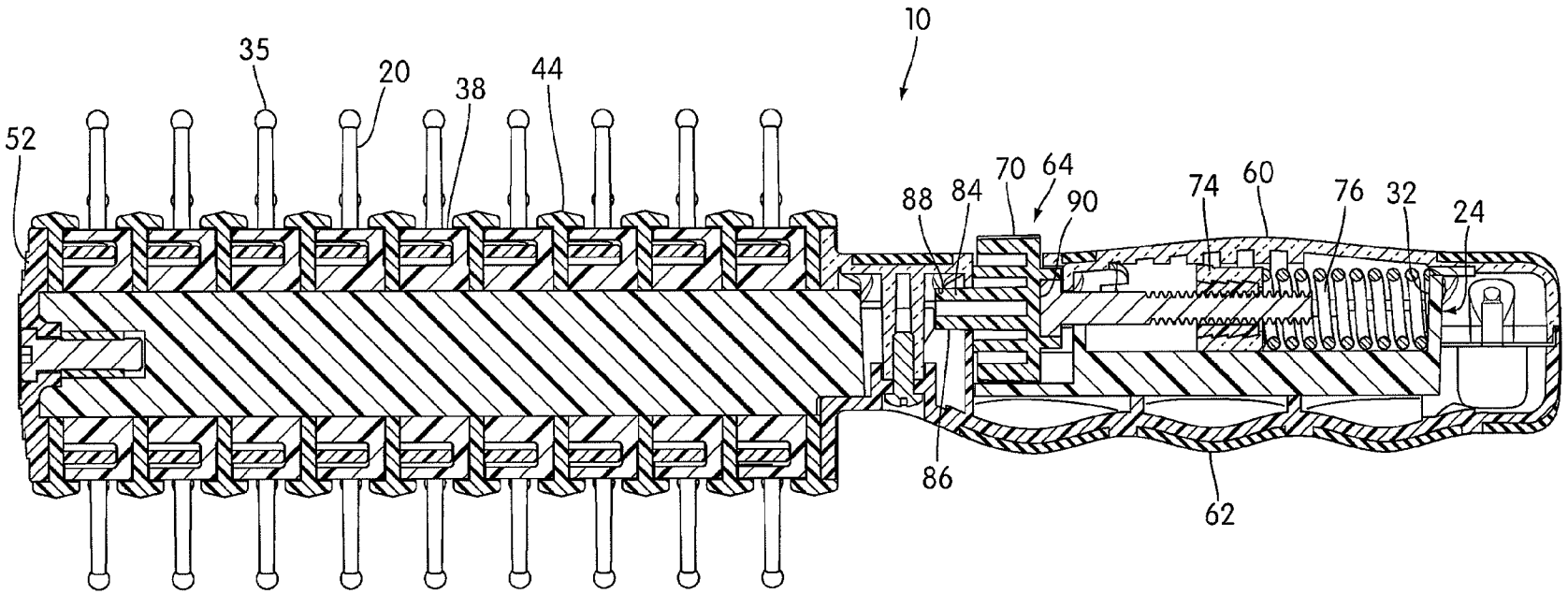
FIG. 4 is a cross-sectional view of the hairbrush taken through the line 4-4 of FIG. 2.

The construction of the adjusting mechanism 22 can be appreciated from FIG. 4. The thumb wheel 70 is mounted within the housing members 60,62 for bidirectional rotational movement. More specifically, and integral post 84 in the thumb wheel 70 is supported by wall structures 86, 88 on the respective handle housing members 60, 62. The hexagonal head 78 of threaded member 72 is held within a hexagonal-shaped recess 90 in the thumb wheel 70. The spring engaging structure 74 is threadedly engaged with the shaft of the threaded member 72. The coil spring 76 is disposed between the spring engaging structure 74 and the back wall 32 of the core 24. The thumb wheel 70 is accessible by a user through the opening 64 in the handle housing member 60 of the assembled hairbrush 10. The thumb wheel 70 and the shaft are aligned with the longitudinal axis of the hairbrush 10. Therefore, the thumb wheel 70 is rotatable about the longitudinal axis of the body portion of the hairbrush 10.

Rotation of the thumb wheel 70 varies the resistance supplied to the hairbrush 10. To increase bristle resistance, the thumb wheel 70 is rotated in a direction to compress the coil spring 76. The coil spring 76 exerts a force on the core 24 which tends to move the core 24 toward and into the handle housings 60,62. This movement of the core 24 causes the brush elements 18 and the spacer elements 44 to compress against one another which increases the force required to rotate the bristles 20 about the core 24. Rotation of the thumb wheel 70 in the opposite direction decreases the force required to rotate the bristles 20. Therefore, the adjusting mechanism 22 is configured to decrease or increase the resistance between the spacer elements 44 and the brush elements 18.

Thus, it can be understood that the adjusting mechanism 22 is a thumb wheel 70 coupled to a biasing coil spring 76. It can also be understood that the adjusting mechanism 22 causes the core 24 to slide back and forth with respect to the housing members 60, 62. Therefore the adjusting mechanism may be considered to be a sliding mechanism in some embodiments of the invention. The adjusting mechanism 22 is configured to press the spacer element 44 and one of the plurality of brush elements 18 together to increase a resistance between them. The increased resistance opposes the rotational movement of each of the brush elements 18 about the longitudinal axis of the body portion of the hairbrush 10. It can also be understood that the adjusting mechanism 22 is configured to press the plurality of brush elements 18 together to increase a resistance between them. The increased resistance opposes the rotational movement of the brush elements 18 about the longitudinal axis of the body portion of the hairbrush 10. Thus, the adjusting mechanism 22 can also be rotated in an opposite direction to decrease or release the resistance. Thus, the adjusting mechanism 22 is configured to increase or decrease the resistance between the brush elements 18.

When brushing hair with the hairbrush 10, the user grips the handle portion of the body portion of the hairbrush 10 and moves the bristles 20 through the hair to be brushed. The bristles 20 of the brush elements 18 that do not encounter sufficiently high resistance in the hair continue to brush through the hair. If a brush element 18 encounters a resistance in the hair (for example, if the bristle encounters a tangle), the bristle 20 is configured to rotate in a direction opposite the brushing direction of the brushing motion to disengage from the resistance in the hair. Each brush element 18 rotates independently of the other brush elements 18 on the body portion of the hairbrush 10. Thus, the movement of one brush element 18 is not dependent on the movement of another one of the brush elements 18. Each brush element 18 is free to move around the longitudinal axis of the brush 10, and thus capable of rotating through any amount of angular rotation from 0 degrees to more than 360 degrees. When one bristle 20 encounters a tangle or other resistance while moving through the hair, the bristle 20 that encounters the resistance rotates away from the tangle in a direction opposite the brushing direction. Another bristle 20 on the brush element 18 simultaneously moves into the hair in a position spaced form the tangle. The outer perimeter wall section 48 of each spacer element 44 overlaps the adjacent brush element 18 and prevents hair from being entangled between a spacer element 44 and a brush element 18 during brushing.

The independent movement of the rotating brush elements 18 provides for maximum hair brushing efficiency because tangles can never impede the brushing motion. Each bristle 20 of the brush elements 18 brushes hair at every possible location in the hair including above a tangle, to the sides of the tangle, and below the tangle, with a continuous brushing motion. The rotating brush elements 18 also allow for maximum hair brushing speed by significantly shortening the time it takes to brush the hair.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A brush for grooming hair, comprising:

a brush body having a handle portion and a bristle carrier portion, wherein the bristle carrier portion has an outer periphery and defines a longitudinal axis; and a plurality of brush elements having a plurality of bristles mounted thereon and moveably mounted on the bristle carrier portion, the plurality of bristles extending generally radially outward from the longitudinal axis and the plurality of brush elements being arrayed generally longitudinally along a length of the bristle carrier portion, wherein each of the plurality of brush elements is configured to rotate independently from one another, and wherein the plurality of bristles is configured so that when one of the plurality of bristles encounters a resistance from a hair, the respective brush element having the one of the plurality of bristles encountering the resistance will move in an opposite direction of brushing thereby causing the one of the plurality of bristles encountering the resistance to move out of engagement with the hair and another one of the bristles on the respective brush element to move into engagement with the hair at a location spaced from the location of the hair which caused the resistance.

2. The brush according to claim 1 further comprising an adjusting mechanism located within the handle portion and is operatively engaged with the plurality of brush elements to adjust a rotational resistance applied to the plurality of brush elements.

3. The brush according to claim 2, wherein the rotational resistance is the amount of force that must be overcome in order to induce rotational movement of the plurality of brush elements about the longitudinal axis.

4. The brush according to claim 1, further comprising a spacer element arranged along the bristle carrier portion and adjacent to a side of the plurality of brush elements.

5. The brush according to claim 1, wherein the handle portion is elongated and configured with an ergonomic gripping surface.

6. The brush according to claim 4, wherein the spacer element is a non-rotatable element.

7. The brush according to claim 2, wherein the adjusting mechanism comprises a thumb wheel coupled to a biasing spring that moves a sliding mechanism.

8. The brush according to claim 7, wherein the thumb wheel is rotatable about the longitudinal axis.

9. The brush according to claim 7, wherein the sliding mechanism engages the plurality of brush elements and is configured to slide back and forth within the handle portion.

10. The brush according to claim 2, further comprising a spacer element arranged along the bristle carrier portion and adjacent to a side of the plurality of brush elements.

11. The brush according to claim 10, wherein the adjusting mechanism is configured to press the spacer element and the plurality of brush elements together to increase the rotational resistance between them, wherein the increased rotational resistance opposes the rotational movement of the plurality of brush element about the longitudinal axis.

12. The brush according to claim 2, wherein the adjusting mechanism is configured to press the plurality of brush elements together to increase the rotational resistance between them, wherein the increased rotational resistance opposes the rotational movement of the plurality of brush element about the longitudinal axis.

13. The brush according to claim 1, wherein the bristles are configured to be movable towards the longitudinal axis to a compressed state when the brush is pressed against a scalp.

14. The brush according to claim 1, wherein the bristles of the brush elements that do not encounter the resistance in the hair continue to brush through the hair and wherein the bristles are configured to be movable towards the longitudinal axis when the brush is pressed against a scalp.

15. The brush according to claim 11, wherein the adjusting mechanism is configured to decrease the rotational resistance between the spacer element and the brush element.

16. The brush according to claim 12, wherein the adjusting mechanism is configured to decrease the rotational resistance between the plurality of brush elements.

17. A brush for grooming hair, comprising:

a brush body having a handle portion and a bristle carrier portion, wherein the bristle carrier portion defines a longitudinal axis;

a plurality of brush elements having a plurality of bristles mounted thereon and moveably mounted on the bristle carrier portion, the plurality of bristles extending generally radially outward from the longitudinal axis and the plurality of brush elements being arrayed generally longitudinally along a length of the bristle carrier portion, wherein each of the plurality of brush elements is configured to rotate independently from one another, and wherein the plurality of bristles is configured so that when one of the plurality of bristles encounters a resistance from a hair, the respective brush element having the one of the plurality of bristles encountering the resistance will move in an opposite direction of brushing thereby causing the one of the plurality of bristles encountering the resistance to move out of engagement with the hair and another one of the bristles on the respective brush element to move into engagement with the hair at a location spaced from the location of the hair which caused the resistance; and an adjusting mechanism located within the handle portion operatively engaged with the plurality of brush elements to adjust a rotational resistance applied to the plurality of brush elements.

18. The brush according to claim 17, further comprising a spacer element arranged along the bristle carrier portion and adjacent to a side of the plurality of brush elements.

19. The brush according to claim 18, wherein the adjusting mechanism is configured to press the spacer element and the plurality of brush elements together to increase the rotational resistance between them, wherein the increased rotational resistance opposes the rotational movement of the plurality of brush elements about the longitudinal axis.

20. The brush according to claim 17, wherein the bristles are configured to be movable towards the longitudinal axis to a compressed state when the brush is pressed against a scalp.

21. The brush according to claim 17, wherein the bristles of the brush elements that do not encounter the resistance in the hair continue to brush through the hair, and wherein the bristles are configured to be movable towards the longitudinal axis when the brush is pressed against a scalp.

* * * * *